United States Patent [19]

Wolf

[11] Patent Number: 4,995,181

[45] Date of Patent: Feb. 26, 1991

[54] LUMINOUS DISPLAY FRAME AND KIT

[76] Inventor: Hugh M. Wolf, 2343 S. Embers La., Arlington Heights, Ill. 60005

[21] Appl. No.: 398,290

[22] Filed: Aug. 22, 1989

Related U.S. Application Data

[63] Continuation of Ser. No. 125,700, Nov. 27, 1987, abandoned.

[51] Int. Cl.[5] ..... A47G 1/06; G09F 13/00

[52] U.S. Cl. ..... 40/152.2; 40/155; 248/314; 248/300; 248/274; 211/89; 211/94; 362/285; 362/225; 362/250; 362/252; 362/806; 206/223

[58] Field of Search ..... 40/152.2, 155, 541, 40/550, 427, 575, 571; 362/249-252, 396, 391, 382, 225, 147, 388, 145, 152, 285, 225, 806, 235; 248/200.1, 206.5, 314, 300, 65, 316.7, 316.2, 241, 274, 278, 279; 428/40; 211/70.1, 94, 89, 26; 206/223, 575, 577

[56] References Cited

U.S. PATENT DOCUMENTS

| | | | |
|---|---|---|---|
| 1,029,734 | 6/1912 | Watmough, Jr. | 40/550 |
| 1,091,623 | 3/1914 | Bland | 40/155 |
| 1,229,044 | 6/1917 | Davis . | |
| 1,446,367 | 2/1923 | Zelan . | |
| 1,523,737 | 1/1925 | Willard | 40/575 |
| 2,052,425 | 8/1936 | Simeone | 362/806 |
| 2,233,280 | 2/1941 | Barnes | 40/152.2 X |
| 2,722,317 | 11/1955 | Goodwin | 211/89 |
| 2,796,688 | 6/1957 | Van Praag | 40/131 |
| 3,025,389 | 3/1962 | Esch | 248/200.1 |
| 3,054,205 | 9/1962 | Sierpin | 40/131 |
| 3,098,611 | 7/1963 | Connell | 40/152.2 |
| 3,184,366 | 5/1965 | Claude | 40/571 X |
| 3,204,090 | 8/1965 | Kvarda, Jr. | 362/249 |
| 3,275,818 | 9/1966 | Campbell | 248/206.5 |
| 3,318,032 | 5/1967 | Robison et al. | 40/152.2 |
| 3,321,730 | 5/1967 | Schlangen | 362/396 |
| 3,404,268 | 10/1968 | Fowler | 362/382 |
| 3,446,953 | 5/1969 | Mylonas | 40/541 |
| 3,451,153 | 6/1969 | Dohanyos | 40/155 |
| 3,500,036 | 3/1970 | Szentveri | 362/249 |
| 3,541,322 | 11/1970 | Bennett | 248/200.1 |
| 3,613,280 | 10/1971 | Tuchinsky et al. | 40/155 |
| 3,692,993 | 9/1972 | Robinson | 362/249 X |
| 3,731,081 | 5/1973 | Yellin | 362/249 |
| 3,886,677 | 6/1975 | Behring et al. | 40/152 |
| 3,894,225 | 7/1975 | Chao | 40/541 |
| 4,096,379 | 6/1978 | Taylor | 362/235 |
| 4,139,955 | 2/1979 | Reiback | 40/427 |
| 4,357,653 | 11/1982 | Kovacs | 362/147 |
| 4,482,944 | 11/1984 | Rossine et al. | 362/225 |
| 4,530,865 | 7/1985 | Sprenger | 428/40 |
| 4,769,749 | 9/1988 | Felski | 362/249 X |
| 4,795,121 | 1/1989 | Comito | 211/89 X |

FOREIGN PATENT DOCUMENTS

| | | | |
|---|---|---|---|
| 2603413 | 3/1988 | France | 40/451 |

*Primary Examiner*—Kenneth J. Dorner
*Assistant Examiner*—J. Hakomaki
*Attorney, Agent, or Firm*—Leydig, Voit & Mayer

[57] ABSTRACT

A luminous display frame and kit therefor having L-shaped corner members connecting side members together to form a frame having an interiorly disposed slot and hollow recess within the side and corner members adapted for containing a plurality of individual light bulbs having a common wire with exit means for a wire through either a side member or corner member.

21 Claims, 4 Drawing Sheets

LUMINOUS DISPLAY FRAME AND KIT

This is a continuation of copending application Ser. No. 125,700 filed on Nov. 27, 1987 abandoned.

BACKGROUND OF THE INVENTION

This invention relates to luminous display frames. In particular, it relates to frames intended to support decorative lights, such as Christmas lights. It further relates to such frames which are easily adjustable by the consumer to various sizes.

Light strings such as Christmas tree lights are typically marketed for use on Christmas trees, but consumers frequently utilize their decorative effect in numerous other situations, specifically including hanging them in windows. Although attractive when installed, the installation of a string of lights in a window is fraught with difficulty. Neither light strings nor windows are designed with the idea of the former being installed in the latter. In an attempt to improvise, consumers have resorted to wires, nails, tape, and adhesives. These makeshift approaches are often unreliable and typically result in damage to either the structure or finish of the window. This problem is so common that stories of intolerable frustation caused by ill-fated attempts at installing Christmas lights in windows has become an integral part of our Christmas folklore.

U.S. 1,446,367 is illustrative of art relating to adjustable picture frames. While useful for displaying pictures, this art has no facility for displaying decorative lights. U.S. 1,229,044, U.S. 3,098,611 and U.S. 2,275,818 all relate illuminated frames, but each has numerous drawbacks such as complicated parts and manufacturing, lack of suitability for window display, unattractive mechanisms, or lack of suitable means for retaining lights and their associated wires.

Thus, there is a long-felt and still unmet need for a means of conveniently installing a string of lights in a window (or other location), which means is easy to use, is attractive to view, and is relatively susceptible to employment without damage to the structure or finish of the window.

SUMMARY OF THE INVENTION

In one respect, the invention is a frame comprising a plurality of side members having a continuous longitudinal slot, and a plurality of corner means for connecting the side members, at least one corner means or side member including an exit passage for communication of the interior of the side member with the space outside the frame.

In another respect, the invention is a frame for displaying a string of lights, comprising, a plurality of side members having a continuous longitudinal slot for receiving the light wire and for retaining the light bulbs or sockets, and a plurality of corner means for connecting the side members.

In yet another respect, the invention is a kit of parts for constructing a frame for displaying a string of lights, comprising a length of side member stock from which individual side members may be cut such that the side members will have a continuous longitudinal slot for receivng the light wire and retaining the light bulbs or sockets, and a plurality of corner means for connecting the side members. Advantageously, the kit may include a string of lights, frame fastening means such as adhesive backed hoop and loop type fasteners and/or a side member cutting guide.

DETAILED DESCRIPTION OF THE INVENTION

Figure 1:
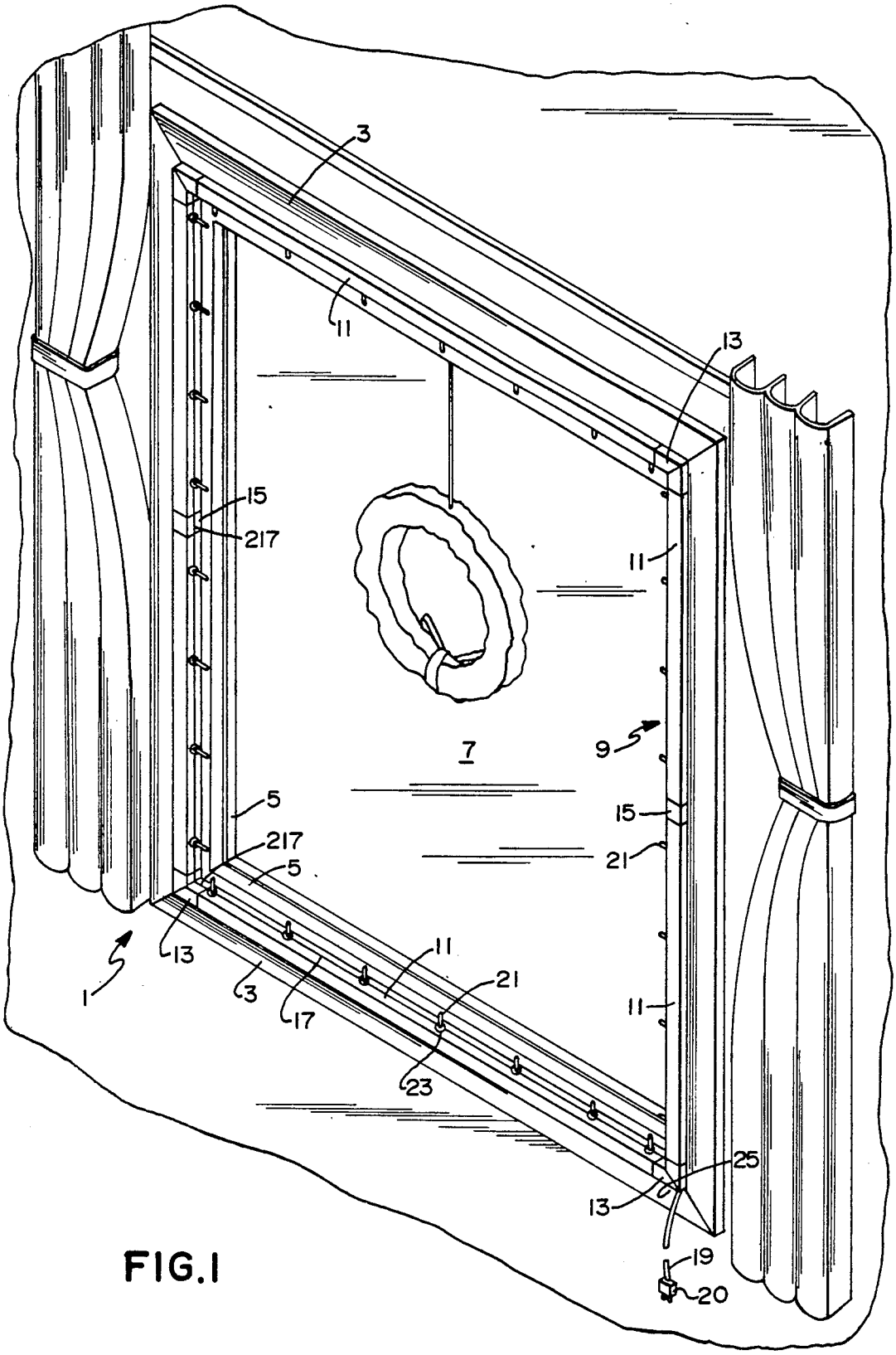
FIG. 1 is a perspective view of a frame of the invention installed in a window.

Referring to FIG. 1, a window 1 has a window frame 3 which secures a recessed sash 5 which in turn secures a pane of glass or other glazing 7. A display frame of the invention 9 rests in the recessed portion of window frame 3 against sash 5, and is secured by friction, hook-and-loop fasteners, tacks, hooks at the top of the window, or other suitable means.

Figure 9:
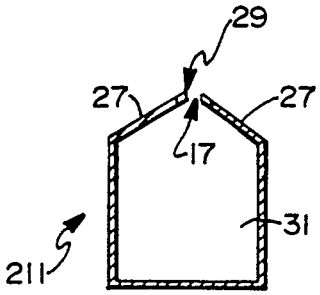
FIG. 9 is a sectional view of a modified embodiment of a side member of the invention.

FIG. 9 is composed of side members 11 which are joined at right angles by corner means 13 and linearly by joint means 15. Side members 11 have a longitudinal slot 17 therein. Optionally, corner means 13 and joint means 15 have a similar slot 217. A string of lights having a common cord 19 and individual bulbs 21 is installed in frame 9 by slipping the cord 19 through slot 17 and pushing bulbs 21 or their associated sockets 23 into slot 17 such that slot 17 frictionally retains bulbs 21 or sockets 23. The plug end 20 of cord 19 passes through an exit means 25 in one corner means 13 so as to be available for connection to a source of electricity.

If corner means 13 or joint means 15 do not have an longitudinal slot 217, then the wire 19 and bulbs 21 can be passed through the interior of corner means 13 or joint means 15, or the wire can pass from one side member 11 to another side member 11 through slot 17 in said side members, thereby bypassing the corner means 13 or joint means 15. If corner means 13 or joint means 15 have no slot 217, and if the string of lights is of the endless loop type, then the latter method of bypassing of the corner means or joint means will be the only available method of installing the lights in the frame.

Figure 2:
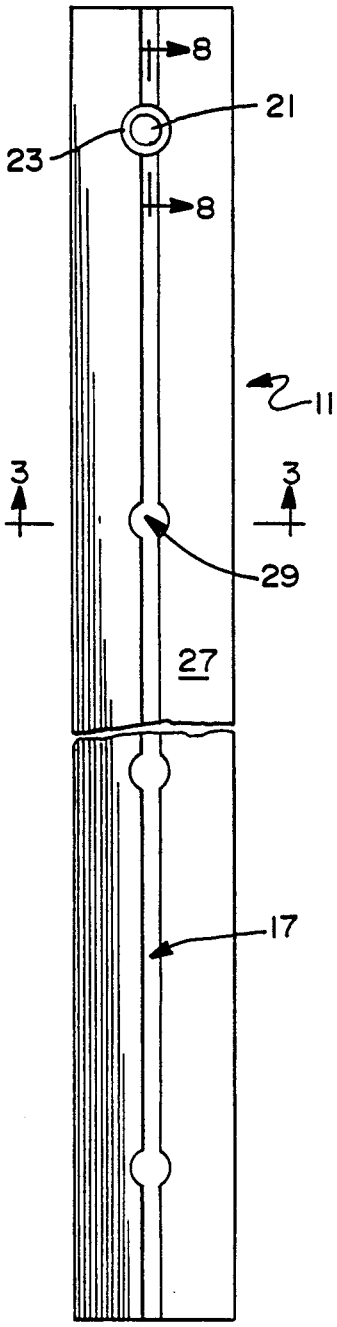
FIG. 2 is a side view of a side member of the invention.

Referring now to FIG. 2, a side member 11 has a receiving face 27. Receiving face 27 has a longitudinal slot 17 for receiving a wire. By the term "longitudinal slot" is meant a continuous groove or opening running the length of the side member, into which the wire may be placed. In the embodiment of FIG. 2, slot 17 is shown with a plurality of optional annual relief areas 29 for receiving a bulb 21 or socket 23. If slot 17 does not have annular relief areas 29, bulbs 21 or sockets 23 can be received by slot 17 itself.

Figure 3:
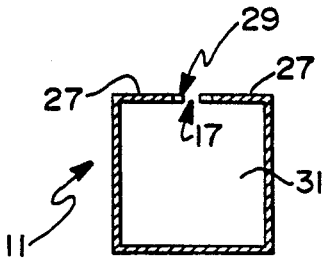
FIG. 3 is a sectional view of the side member of FIG. 2, takken through section lines 3—3.

As shown in FIG. 3, side member 11 is square in cross-section, although any other shape could be used. In particular, FIG. 9 shows a side member 211 having a pentagonal cross-section. The embodiment of FIG. 9 is particularly attractive and the angled receiving faces 27 reflect light from the bulbs to the viewer. In both FIG. 3 and FIG. 9, the side member 11 or 211 defines a hollow passage 31 which receives the wires and if side member 11 or 211 is opaque, shields them from view. Side members 11 and 211 both have a longitudinal slot 17 and are both shown with optional annular relief areas 29. A string of lights may also be installed by pulling or pushing the wiring through the passage 31 with each light socket similarly pushed or pulled along slot 17.

Figure 4:
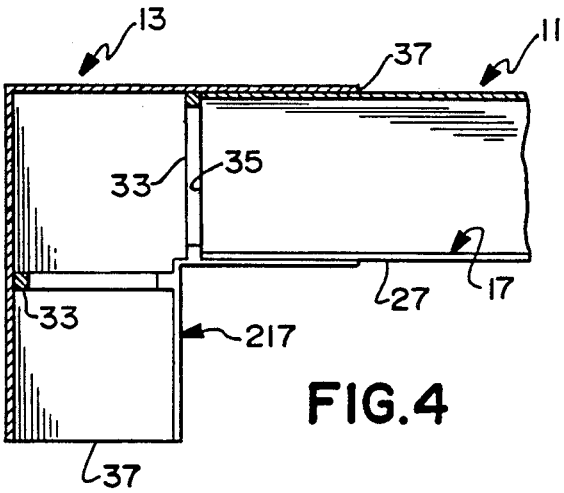
FIG. 4 is a cutaway view of one embodiment of a corner means.

Referring to FIG. 4, a modified corner means 13 is shown in cross-section, with one side member 11 also in cross-section. Side member 11 is shown with receiving face 27, slot 17, and one end 35 to cut at a right angle. Corner means 13 has two receiving ends 37 for slideably receiving end 35 of side member 11, and a longitudinal slot 217. Stop means 33 limits the distance which side members 11 can slide into corner means 13.

Figure 5:
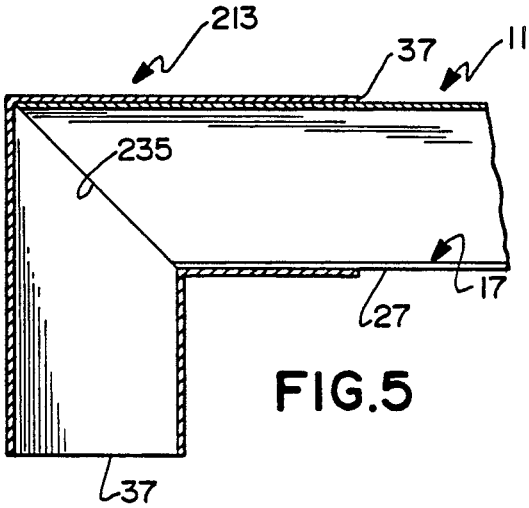
FIG. 5 is a cutaway view of another embodiment of a corner means.

FIG. 5 shows a modified corner means 213 having open ends 37 but no longitudinal slot. Side members 11 is shown with a 45° angle end. In this embodiment no stop means is provided in corner means 213. The travel of side members 11 in to end 37 of corner member 213 is limited by the outside corner of corner means 213. In FIG. 5, side member 11 is shown without the optional annular relief area 29 shown in FIGS. 2 and 3 and corner means 213 is shown without the optional slot 217 shown in FIG. 3.

Figure 6:
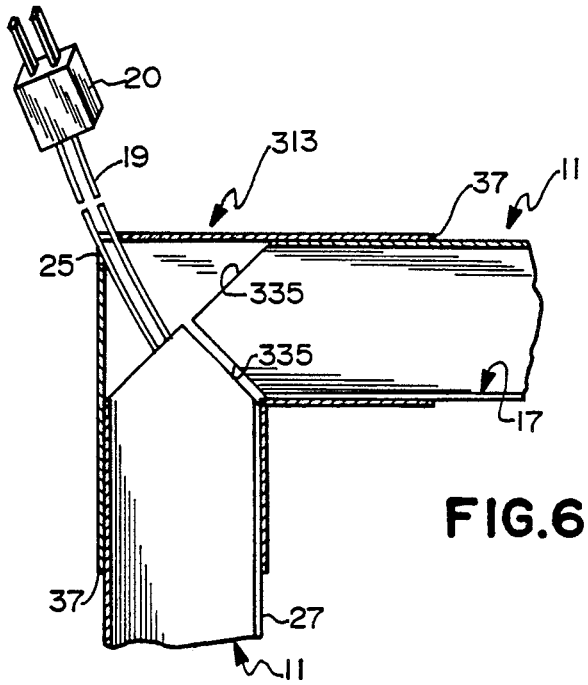
FIG. 6 is a cutaway view of a modified embodiment of the corner means of FIG. 5.

Referring to FIG. 6, a modified corner means 313 has ends 37 and an exit means 25 through which the plug end 20 of cord 19 passes. In FIGS. 6, exit means 25 is a partial slot defining an opening having a continuous periphery in the surface of said corner means. As shown, exit means 25 is too small for plug 20 to pass through exit means 25, but it is contemplated in this embodiment that corner means 313 would be made of a resilient, flexible material such that corner means 313 could be compressed by squeezing to deform thereby stretching the angled opening into a more planar opening thereby adapting the exit means 25 for the passage of plug 20. Side members 11 have two 45° angle ends 335 and in this embodiment are illustratively glued to corner means 313. In FIG. 6, corner means 313 is shown without slot 217 shown in FIG. 3. Side member 11 is shown with slot 17, but without annular relief areas 29 shown in FIGS. 2, 3, and 4.

Figure 7:
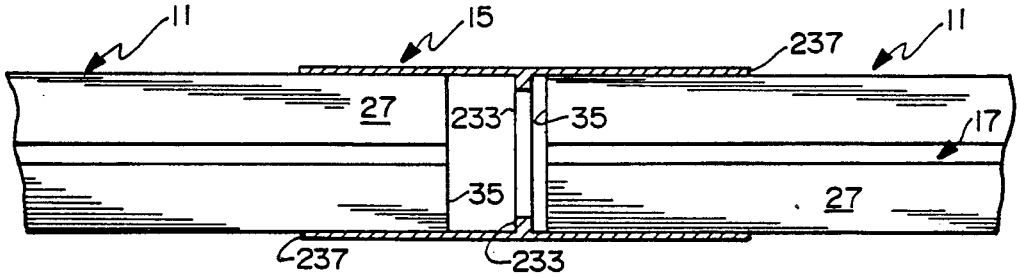
FIG. 7 is a cutaway view of a joint means with an alternative side member embodiment.

In FIG. 7, two side members 11 are colinearly joined by a joint means 15. Joint means 15 has ends 237 for receiving ends 35 of side members 11, and optional stop means 233 for limiting the movement of side members 11 into joint means 15. Side members 11 have ends 35 which butt against stop means 233 and receiving face 27 which has slot 17 and annular receiving areas 29. In another embodiment the stop means 233 of the joint means such as butt joint connector 15 is eliminated and a press fit frictional butt joint is relied upon.

Figure 8:
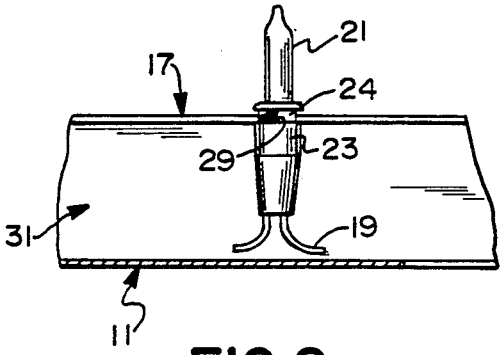
FIG. 8 is a sectional view of the side member of FIG. 2, taken through section lines 8—8.

FIG. 8 shows a view of a side member 11 of FIG. 2 with a bulb 21 fitted in a socket 23 which is retained by annular relief area 29 of slot 17 by frictional gripping of groove 24 of socket 23. Wires 19 pass through hollow space 31 of side member 11.

Figure 10:
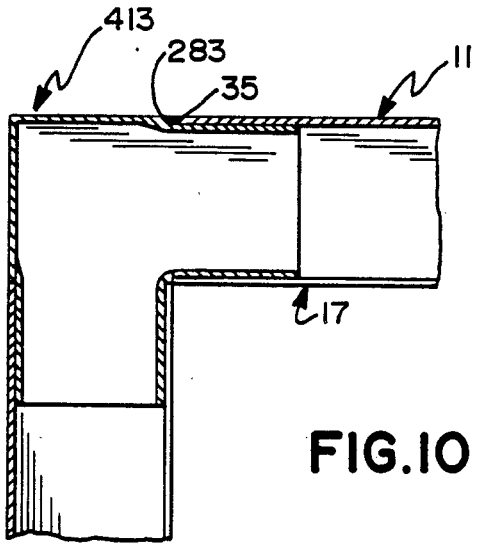
FIG. 10 is a sectional view of a modified embodiment of a corner means of the invention.

FIG. 10 illustrates a modified version of the invention in which the corner means 413 is slideably received in end 35 of side member 11 which has a slot 17. A lip 283 on corner means 413 serves as a stop for end 35 of side member 11.

Figure 11:
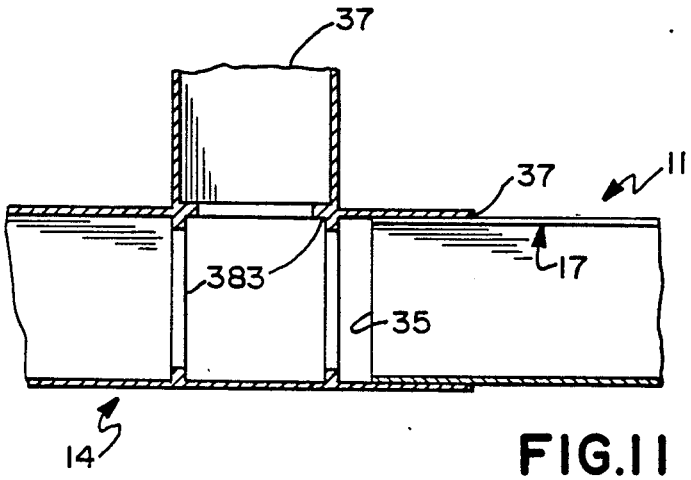
FIG. 11 is a sectional view of a combination means of the invention.

FIG. 11 shows a combination end means and joint means (combinaton means 14) for forming a frame having two or more rectangular sections. Combination means 14 has three ends 37 for receiving ends 35 of side members 11 which have slot 17. Stop means 383 limit the travel of end 35 of side members 11 which is shown partially inserted into one end 37 of combination means 14. By use of two combination means 14 and four corners means 13, 213, 313, 413, or 513, it is possible to make a frame with a block-8 shape. If combination means 14 is modified so as to provide a fourth end 37, coplaner with the other ends 37, then a cross-hatch frame can be constructed. It will be appreciated that polygonal and other shapes may be formed by adjusting the angle between joint ends and that other stop and joint means described herein for corner joints may be employed with the combination means.

Figure 12:
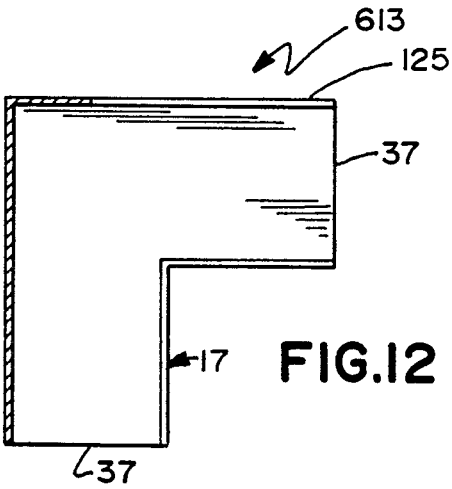
FIG. 12 is a modified corner means of the invention.

Referring to FIG. 12, a modified corner means 613 has a slot 17, ends 37, and an exit means 125. Exit means 125 is a partial slot defining an opening which, because it extends to end 37, does not have a continuous defining periphery in the surface of said corner menas. In use, it is expected that a cord will be passed through exit means 125 as a side member is inserted into the end 37 proximate to exit means 125. A slot similar to exit means 125 may also be formed in a side member proximate an end to serve a similar function.

The side members, corner means and joint means of the invention can be made from any number of materials. Metals such as aluminum, chrome plated steel, and stainless steel are suitable, but plastics such as polypropylene, polystyrene, polyesters, and polycarbonates are preferred because of their light weight, lack of electrical conductivity, and ease of cutting.

Although the frames of the invention may be manufactured in particular sizes, a preferred means of manufacture is the production of a kit of parts from which the consumer would cut side members to desired lengths and join them with corner means and optionally joint means. Advantageously, the kit may include one or more of the following: one or more strings of electric lights, a cutting guide for alignment of side members to make straight cuts of proper dimensions, and fastening means such as double-backed adhesive strips or adhesive backed hook and loop type fasteners (such as that sold under the brand name Velcro), tacks, screws, or eyelet screws.

Figure 13:
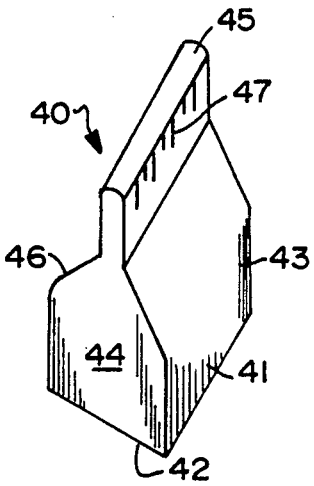
FIG. 13 is a perspective view of a cutting guide of the invention.

Referring now to FIG. 13, a perspective view is presented of a cutting guide 40 of the present invention. Cutting guide 40 is a solid member 41 having a base 42, side 43, planar end 44 and projecting extension 45. Member 41 is elongate with a uniform cross-section defined by perimeter edge 46. The extension 45 has a plurality of spaced markings 47 for measuring purposes. In use cutting guide 40 is sized for insertion into a side member such as side member 211 of FIG. 9. Optionally, markings 47 may be used to indicate a measured distance from an end of both guide 40 and side member 211, then the side member may be marked and cut using the guide 40. The guide is repositioned with the end 44 abutting the cutting mark and then the guide and side member are gripped to sturdy the side member 211 and prevent undesirable and potentially dangerous deformation of the side member. Such deformation may cause a cutting tool such as a knife to slip thereby presenting a safety hazard. Also, deformation of the side member makes obtaining a straight or desired cut difficult. During a cutting operation the extension 45 extends through slot 17 of the side member and both the guide 40 and side member 211 may be gripped firmly. The end 44 of the member 41 is then moved to abut the cutting line and a cut is made whereupon the guide may easily be removed e.g. by sliding from the side member.

The joining of the side members by corner means and joint means may take place before or after insertion of the wire and lights. The side members and the corner means and joint means are preferably such that one is slideably receivable in the other, but other means such as a glued butt joint are suitable. When the preferred slideably receivable arrangement is employed, the pieces are preferably sized for a fricition fit, but fasteners such as glue, staples, or tape can be used instead of or in addition to friction to bind the pieces together.

When very large frames are made it may be necessary to join two or more light strands together. This is facilitated if the hollow passage 13 of the side members is sufficiently large that conventional electrical plugs can fit therein.

It will also be appreciated that side members, corner means such as corner members and side member joint means can have apertures stamped or cut therein to adapt the frame for hanging over screws attached to a window frame or sash.

The above description serves to illustrate the invention and its advantages, and should not be interpreted as limiting since further modifications of the disclosed invention will be apparent to those skilled in the art. All such modificatons are deemed to be within the scope of the invention as defined by the following claims.

What is claimed is:

1. A frame for displaying a plurality of individual light bulbs which are connected by a common wire, comprising:

(a) a plurality of substantially tubular side frame members, each of which has at least five faces defining a hollow passage, wherein an adjacent pair of said faces have edges which are spaced apart so as to define a continuous longitudinal slot for receiving the common wire, the width of the slot being such that the spaced-apart edges serve as means for gripping and retaining the individual light bulbs at any point along the slot and substantially perpendicular to the slot; and (b) a plurality of corner frame members, each corner frame members connecting the ends of two of said side frame members in a non-linear orientation;

at least one of said frame members having an exit passage through which the common wire extends.

2. The frame of claim 1 wherein said members and said corner means are such that one is slideably receivable in the other.

3. The frame of claim 1 wherein said corner means includes a continuous longitudinal slot for receiving the common wire.

4. The frame of claim 2 wherein said side members are slideably receivable in said corner means.

5. The frame of claim 2 wherein said corner means includes a stop means for limiting the extent of slideable receivability.

6. The frame of claim 1 wherein at least one of said corner frame members includes said exit passage, the exit passage comprising a partial slot.

7. The frame of claim 6 wherein the partial slot defines an opening having a continuous defining periphery in the surface of said corner means.

8. The frame of claim 7 wherein said corner means is constructed of resilient deformable material and the exit passage defines an area which is enlarged upon compression of said corner means.

9. The frame of claim 6 wherein the partial slot defines an opening which does not have a continuous defining periphery in the surface of said corner means.

10. The frame of claim 1 additionally comprising at least one joint means connecting two side members in a linear orientation, said side members and said joint means being such that one is slideably receivable in the other.

11. The frame of claim 10 wherein said side member is slideably receivable in said joint means.

12. The frame of claim 1 further comprising a combination means for connecting two side members in a linear orientation and at least one other side member in an orientation non-linear to said two side members.

13. The frame of claim 1 wherein the means for gripping the light bulbs further comprises enlarged portions of the slot, light bulbs being frictionally receivable therein.

14. The frame of claim 13 wherein each enlarged portion is an annular relief area.

15. The frame of claim 1 wherein said frame members have a plurality of faces defining a rectangular cross-section.

16. A kit of parts for constructing a frame for displaying a plurality of individual light bulbs connected by a common wire, comprising:

(a) a length of stock from which a plurality of substantially tubular side frame members may be cut, said stock being configured such that each side frame member cut therefrom has at least five faces defining a hollow passage, wherein an adjacent pair of said faces have edges which are spaced apart so as to define a continuous longitudinal slot for receiving the common wire, the width of the slot being such that the spaced-apart edges serve as mean for gripping and retaining the individual light bulbs at any point along the slot and substantially prependicular to the slot; and (b) a plurality of corner frame members, each for connecting the ends of two said side frame members in a non-linear orientation;

at least one of said frame members having an exit passage through which the common wire extends.

17. The kit of claim 16 further comprising a plurality of individual light bulbs having a common wire.

18. The kit of claim 16 further comprises a cutting guide.

19. The kit of claim 16 further comprising fastening means for connecting said frame to a supporting structure.

20. The frame of claim 1 wherein said longitudinal slot in said side members is such that said slot is in a plane parallel to the plane of the frame.

21. The frame of claim 1 wherein said frame members have a plurality of faces defining a pentagonal cross-section.

* * * * *

UNITED STATES PATENT AND TRADEMARK OFFICE

CERTIFICATE OF CORRECTION

PATENT NO. : 4,995,181

DATED : February 26, 1991

INVENTOR(S) : Hugh M. Wolf

It is certified that error appears in the above-identified patent and that said Letters Patent is hereby corrected as shown below:

Col. 2, line 10, cancel "takken" and insert --taken--.

Col. 3, line 29, after "end" insert --235--.

Col. 3, line 39, cancel "FIGS." and insert --FIG.--.

Col. 5, line 21, cancel "fricition" and insert --friction--.

Column 5 :

Claim 1, line 15, cancel "members" and insert --member--.

Claim 2, line 1, before "members" insert --side [illegible]--.

Claim 2, line 2, cancel "means" and insert --frame members--.

Claim 3, lines 1 and 2, cancel "means includes" and insert --frame members include--.

Claim 4, line 2, before "members" insert --frame--.

Claim 4, line 2, cancel "means" and insert --frame members--.

Column 6:

Claim 5, line 1, before "said" insert --each of--.

Claim 5, line 1, cancel "means" and insert --frame members--.

Claim 5, line 2, cancel "a".

UNITED STATES PATENT AND TRADEMARK OFFICE

CERTIFICATE OF CORRECTION

PATENT NO. : 4,995,181

DATED : February 26, 1991

INVENTOR(S) : Hugh M. Wolf

It is certified that error appears in the above-identified patent and that said Letters Patent is hereby corrected as shown below:

Column 6:

Claim 7, line 3, cancel "means" and insert --frame member--.

Claim 8, line 1, cancel "means" and insert --frame member--.

Claim 8, line 4, cancel "means" and insert --frame member--.

Claim 9, line 3, cancel "means" and insert --frame member--.

Claim 10, line 2, before "connecting" insert --for--.

Claim 10, line 2, before "members" insert --frame--.

Claim 10, line 3, before "members" insert --frame--.

Claim 11, lines 1 and 2, cancel "member is" and insert --frame members are--.

Claim 12, line 2, before "members" insert --frame--.

Claim 12, line 3, before "member" insert --frame--.

Claim 12, line 4, before "members" insert --frame--.

Claim 18, line 1, cancel "comprises" and insert --comprising--.

Claim 20, line 2, before "members" insert --frame--.

UNITED STATES PATENT AND TRADEMARK OFFICE

CERTIFICATE OF CORRECTION

PATENT NO. : 4,995,181

DATED : February 26, 1991

INVENTOR(S) : Hugh M. Wolf

It is certified that error appears in the above-identified patent and that said Letters Patent is hereby corrected as shown below:

Column 6: claim 5, line 2, cancel "a".

Signed and Sealed this

Fifteenth Day of September, 1992

*Attest:*

DOUGLAS B. COMER

*Attesting Officer*

*Acting Commissioner of Patents and Trademarks*